United States Patent [19]

Libra

[11] Patent Number: 4,555,877

[45] Date of Patent: Dec. 3, 1985

[54] PREFABRICATED MULTI-STORY BUILDING

[76] Inventor: Fausto Libra, Via Gustavo Vagliasindi 9, Catania, Italy

[21] Appl. No.: 434,045

[22] Filed: Oct. 13, 1982

[51] Int. Cl.[4] ..... E01F 9/00

[52] U.S. Cl. ..... 52/79.4; 52/176; 52/236.2

[58] Field of Search ..... 52/174, 79.4, 189, 187, 52/186, 188, 176, 175, 236.2, 729, 82

[56] References Cited

U.S. PATENT DOCUMENTS

| | | | |
|---|---|---|---|
| 584,640 | 6/1897 | Kaufman et al. | 52/73 |
| 1,280,726 | 10/1918 | Havens | 52/91 |
| 1,704,499 | 3/1929 | D'Humy | 52/176 |
| 2,710,584 | 6/1955 | Ross | 52/91 |
| 2,715,953 | 8/1955 | Marrow | 52/236.2 |
| 3,105,999 | 10/1963 | Piazolo | 52/176 |
| 3,136,092 | 6/1964 | Contini | 52/175 |
| 4,136,492 | 1/1979 | Willingham | 52/79.4 |

FOREIGN PATENT DOCUMENTS

| | | | |
|---|---|---|---|
| 238416 | 6/1965 | Austria | 52/174 |
| 642287 | 7/1962 | Italy | 52/175 |

*Primary Examiner*—Donald G. Kelly
*Assistant Examiner*—Kathryn Ford
*Attorney, Agent, or Firm*—Vaden, Eickenroht, Thompson & Jamison

[57] ABSTRACT

There is disclosed a prefabricated, multi-story building, such as a garage, comprising two groups of sector-shaped floors which have adjacent ends providing a zone of access from one floor to another.

6 Claims, 8 Drawing Figures

Fig. 1
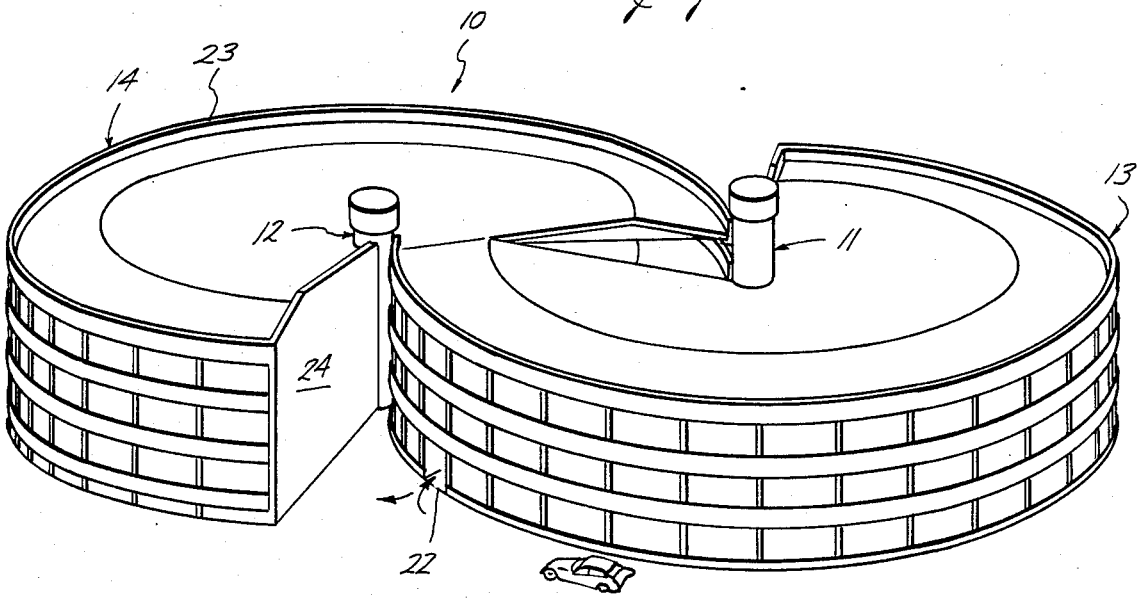
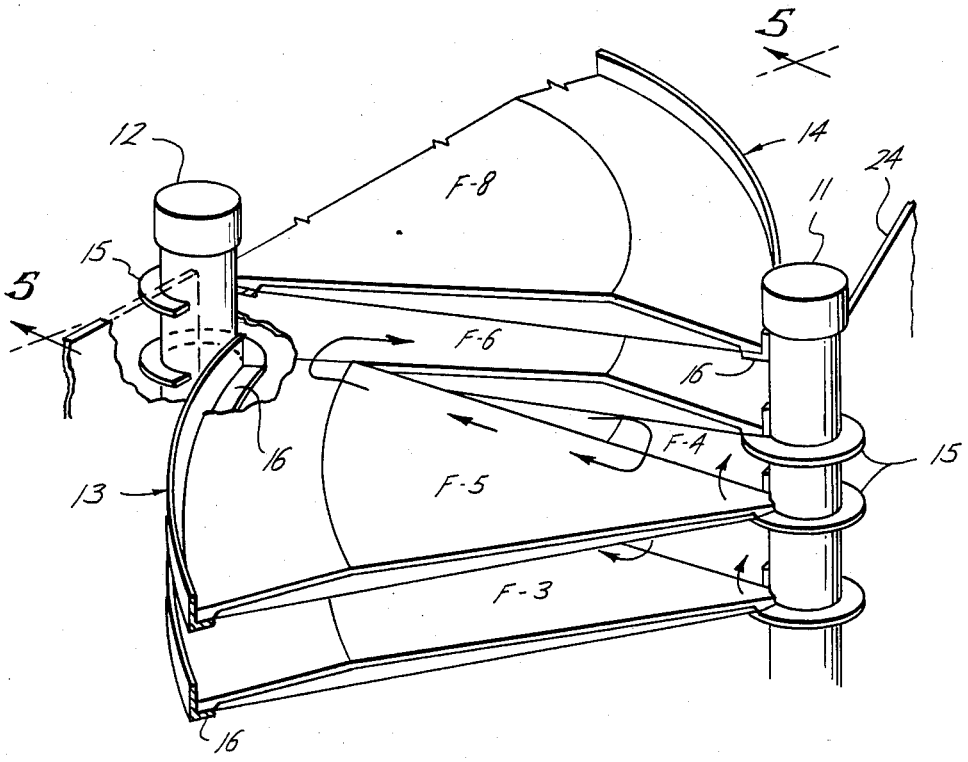
Fig. 4

PREFABRICATED MULTI-STORY BUILDING

This invention relates in general to a prefabricated, multi-story building; and, more particularly, to an improved building of this type which is especially well suited as a parking garage or the like wherein access may be had between floors by means of gradually inclined ramps.

Prior buildings of this type, and especially parking garages, have required the fabrication of components of a large number of different sizes and shapes, thereby defeating the primary purpose of prefabricated structures in general. More particularly, it has been customary to form the ramps by means of a wide variety of prefabricated beams supported at their opposite ends by support members of different types.

The object of this invention is to provide a prefabricated, multi-story building which is constructed from components of a minimum variety of size and shape; and, more particularly, which is constructed primarily of identical beams which are so supported at their opposite ends as to not obstruct the floor area between them.

These and other objects are accomplished, in accordance with the illustrated embodiment of the invention, by a building of the type described having first and second columns adapted to be mounted in laterally spaced-apart, upright positions, first and second arcuate walls adapted to be mounted in upright positions coaxially of the first and second columns, respectively, and a plurality of identical beams adapted to be supported at their opposite ends by the columns and walls to form two sector-shaped floors. More particularly, the first column and second wall have means to support an end of each beam of the first and second group of beams, and the second column and first wall having means to support the opposite ends of each beam of the first and second groups of beams, whereby the beams of one group form a first sector-shaped floor and those of the second group form a second sector-shaped floor having an end adjacent the end of the first floor which provides a ramp to permit access between the floors.

More particularly, the first-mentioned beam supporting means supports one end of each beam of the first group and the other end of each beam of the second group on one horizontal level, and the second-mentioned beam supporting means supports the other end of each beam of the first group and one end of each beam of the second group on another horizontal level. More particularly, the side edges of each beam diverge from their one end to their other end, and top surfaces thereof are asymmetrical end-for-end and so inclined that, with one end of each beam of the first group supported on a flange of the first column and the other end on a flange of the first wall to form the first floor, and the one end of each beam of the second group supported on a flange of the second column and the other end by a flange of the second wall to form the second sector-shaped floor, the end of one floor defines an inclined ramp which merges with the end of the second floor.

Thus, each beam has means at each end thereof which permit one end to be supported on a lower level than the other end, and, when the beam is so supported, its top surfaces are upwardly inclined from the opposite ends at equal angles with respect to the horizontal so as to intersect nearer such other end than the one end—i.e., asymmetrically end-for-end. In the preferred and illustrated embodiment, each beam inclindes a top flange in which its top surfaces are formed, and a web extending laterally intermediate the side edges from one end to the other, and the means by which the beam is supported includes a pad at each end having a lower surface parallel to the lower surface of the other pad.

In the drawings, wherein like reference characters are used throughout to designate like parts:

FIG. 1 is a perspective view of a garage constructed in accordance with the present invention, and as seen from above and to one side thereof;

FIG. 4 is an enlarged perspective view of adjacent ends of the vertically successive floors of the two groups including the ramps for access between them;

Figure 2:
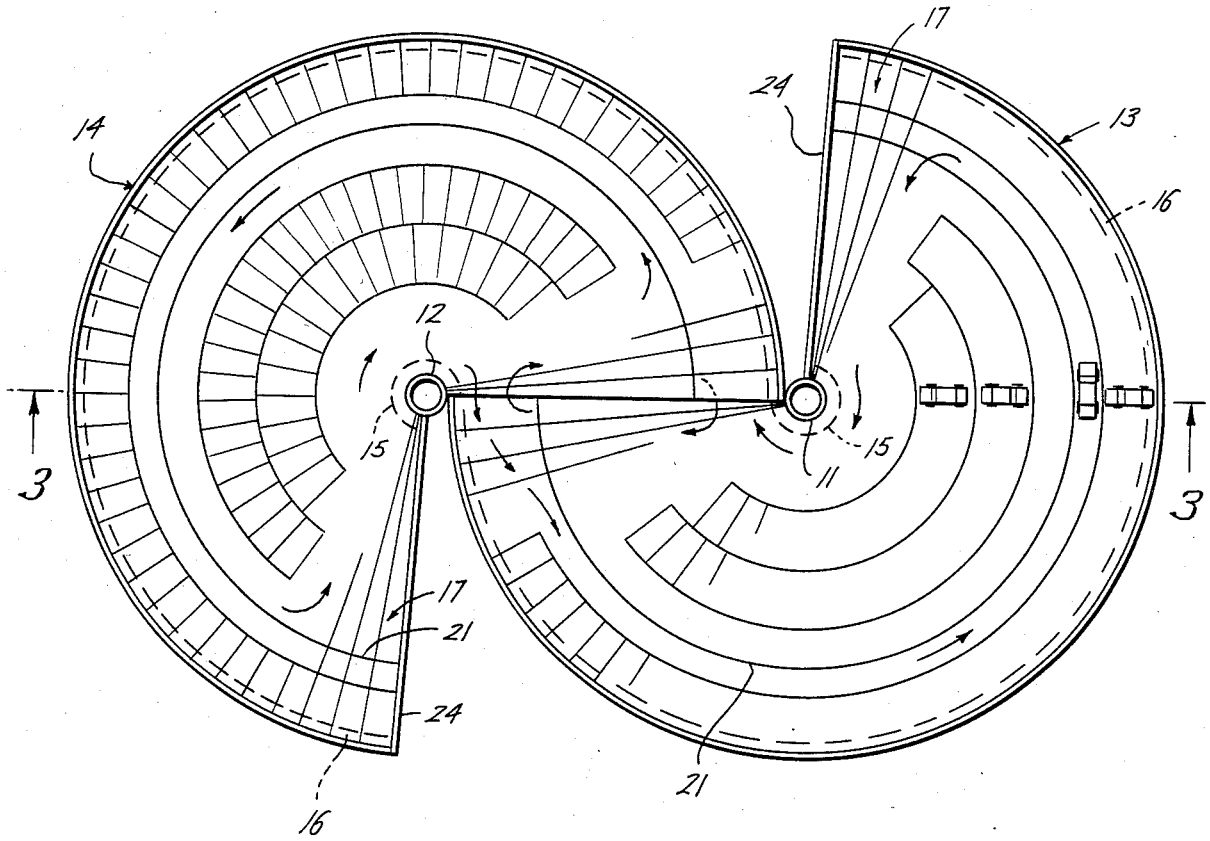
FIG. 2 is a top plan view of the garage shown in FIG. 1, with arrows indicating access between and about the floors and boundary lines indicating an arrangement of parking spaces on the top floors of the two groups of floors.
Figure 3:
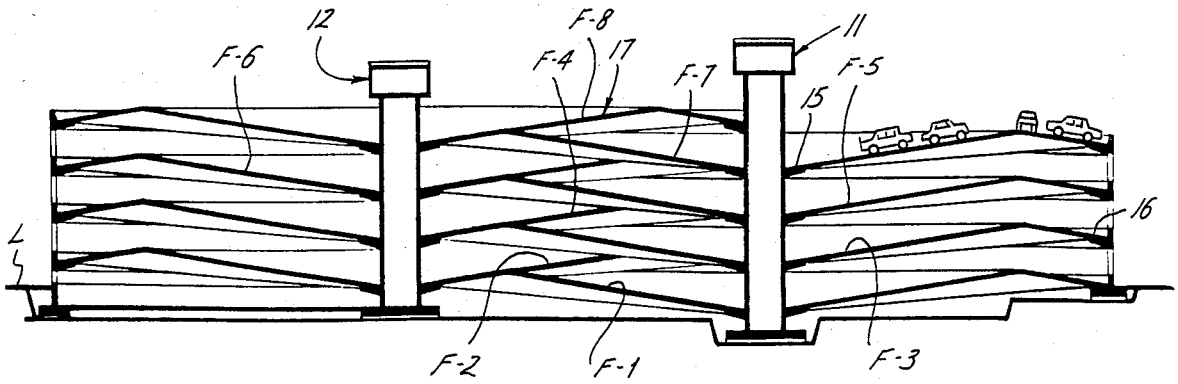
FIG. 3 is a vertical sectional view of the garage of FIGS. 1 and 2, as seen along broken lines 3—3 of FIG. 2.
Figure 6:
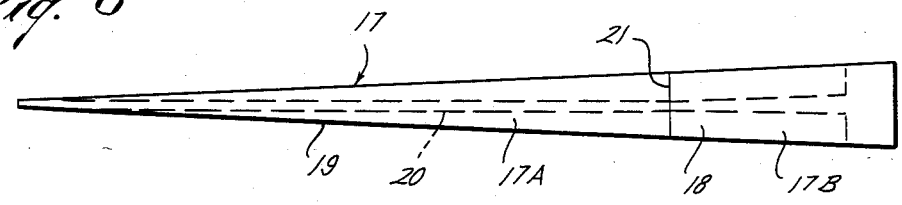
FIG. 6 is a top plan view of one of the beams.

With reference now to the details of the above-described drawings, the garage shown in FIGS. 1, 2 and 3, and indicated in its entirety by reference character 10, comprises first and second groups of vertically successive, sector-shaped floors with an end of each floor of each group being adjacent an end of each floor of the group to provide a zone of access between them. More particularly, each such group of floors extends from such end to its opposite end about an arc of about 270° so that, as will be apparent from FIG. 2, there is an optimum use of the land on which the garage is situated. It will be understood, however, that each group of floors may extend about an arc slightly greater than 270° or, for that matter, slightly or even a good deal less than 270°, and further that the two groups of floors need not extend about an arc of the same angle. Also, this invention contemplates that the building may be used for purposes other than a garage, although for purposes of illustration, it will be described in the context of a garage.

In any event, the garage includes first and second columns 11 and 12, respectively, having footings which permit them to be mounted in upright, laterally spaced-apart relation. As shown in FIG. 3, the first column 11 is taller than the column 12 and its footing is mounted on a lower level than the footing of the column 12. The garage also includes first and second arcuate walls 13 and 14, respectively, which are also adapted to be mounted in upright positions, with the first wall arranged concentrically of the first column 11, and the second wall 14 arranged concentrically of the second column 12. As shown in FIG. 3, the second wall 14 is taller than the first wall 13, and the footing of wall 14 is mounted on the same level as column 12, while the footing of wall 13 is mounted on a higher level. Preferably, and as shown, the radius of each floor is substantially equal to the distance between the columns 11 and 12 so that the adjacent ends of the two groups of floors are laterally co-extensive.

Each of the columns is provided with vertically spaced flanges 15 about a portion thereof, and each of the arcuate walls is provided with vertically spaced flanges 16 about the inner side thereof. As previously described, and as shown in the drawings, the flanges of the first wall are disposed on the same horizontal level as the flanges of the second column 12, while the flanges of the second wall 14 are formed on the same horizontal level as the flanges of the first column 11, but equal distances above or below the flanges of the first column and second wall.

More particularly, as best shown in FIG. 4, the flanges 15 of each column extend about approximately 270° of each column, so that the ends thereof are disposed in substantially the same vertical plane as the ends of the flanges of the arcuate wall arranged concentrically of the other column. Thus, as best shown in FIG. 4, the end wall 13 joins the second columns 12 substantially tangentially thereof, while the end wall 14 joins the column 11 substantially tangentially thereof. Since the flanges 15 of the first column 11 are on the same horizontal level as the flanges 16 of the second wall 14, they will merge or form a horizontal continuation thereof, and, since the flanges 15 of the second column 12 are on the same horizontal level as the flanges 16 of the first arcuate wall 13, they will also merge or form horizontal continuations thereof. More particularly, the merging flange of the first column and second wall are spaced equal vertical distances above or below the merging flanges of the second column and first wall.

Figure 5:
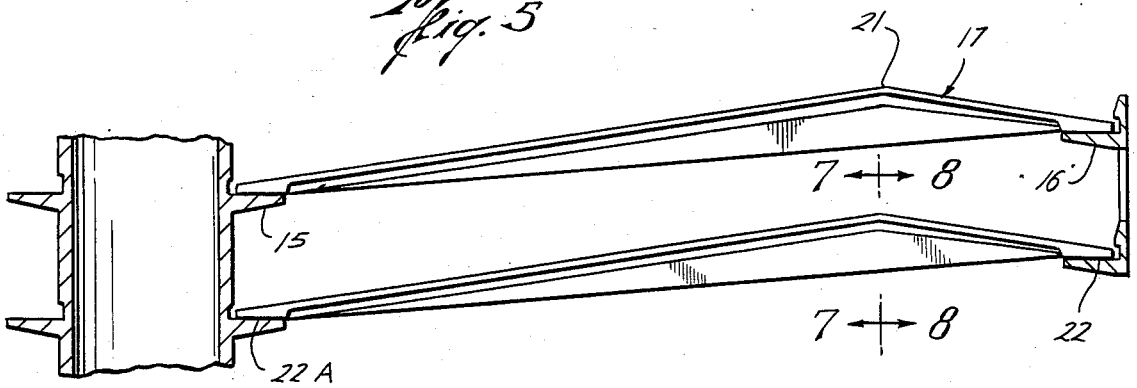
FIG. 5 is an enlarged vertical sectional view of vertically successive floors formed by one group of beams, and as seen along broken lines 5—5 of FIG. 4.
Figure 7:
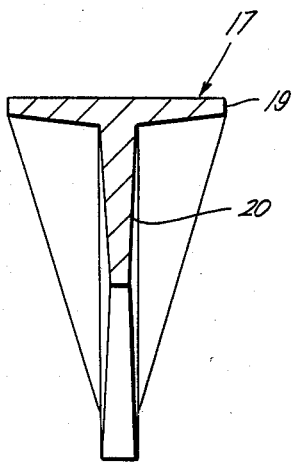
FIG. 7 is an enlarged vertical sectional view of one of the beams, as seen along broken lines 7—7 of FIG. 5.
Figure 8:
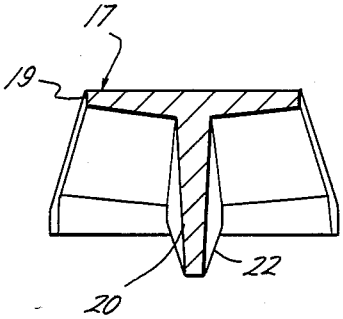
FIG. 8 is another enlarged, vertical sectional view of the beam, as seen along broken lines 8—8 of FIG. 5.

Each of the beams 17 comprises a sector-shaped top flange 18 whose opposite side edges 19 diverge from a narrow end to a wide opposite end. A web or vertical flange 20 extends beneath the top flange from one end to the other intermediate the opposite side edges of the top flange. Footings 21 and 22 formed at the narrow and wide ends of the beam have lower support surfaces which are parallel to one another for resting upon the vertically spaced flanges of the columns and arcuate walls, as best shown in FIG. 5.

The top flange 17 of each beam has top surfaces 17A and 17B which are inclined upwardly from opposite ends of the beam so as to intersect along a peak or ridge 21. More particularly, each such surface extends from its adjacent end at the same angle with respect to the horizontal so that the peak is nearer the wide end of the beam, and, in this sense, the top surfaces are asymmetrical end-for-end.

More particularly, the narrow end of each beam of each floor is supported on a flange of a column, while the wide end thereof is supported on a flange of the arcuate wall which is arranged coaxially of that column. Consequently, at the zone of access between the floors of the two groups of floors, the beams at each end of each floor are oppositely disposed end-for-end. Thus, as best shown in FIG. 4, the top surfaces 17A of the beam at one end of each floor form an inclined ramp and the top surfaces 17B thereof merge with the top surfaces 17A of the beams at the adjacent end of the next floor to permit access from one floor to the other as the cars move in opposite radial directions along paths indicated by the arrows of FIG. 4.

Thus, these adjacent ends of vertically successive floors of the two groups of floors provide areas in which automobiles may turn around to pass from one ramp to the next ramp in the event the driver of the automobile intends to go to the next lower or upper floor. Alternatively, of course, having reached the next upper or lower floor, the driver may wish to traverse that floor in search of a parking space, in which case he would move along an outer path near the peaks 21, or along an inner path close to each column near the narrow ends of the beams supported thereon, as indicated by the arrows in FIG. 2. As best shown by the boundary lines of FIG. 2, parking spaces may be arranged in arcuate patterns about the outer path of each floor as well as intermediate the inner and outer paths thereof.

Automobiles may enter or leave the lowermost floor F-1 through any suitable opening about the arcuate wall 13 as shown at 22 in FIG. 1. This opening would, of course, be at surface level L (see FIG. 3) which is generally on the same level as the ends of the flat portions 17B of the beams forming the right hand group of floors. As also shown in FIG. 3, vertically successive floors F-2 through F-8 are formed by alternate groups of beams, with floors F-7 and F-8 being the top floors.

The arcuate walls may extend for the full height of the group of floors which they surround, or, alternatively, may be formed in vertically stacked sections. In any event, the arcuate walls preferably have windows formed therein and upstanding rims 23 at the outer periphery thereof. The ends of the groups of walls opposite the ends which are adjacent one another are closed as shown at 24.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A prefabricated, multi-story building, comprising first and second columns adapted to be mounted in laterally spaced-apart, upright positions, first and second arcuate walls adapted to be mounted in upright positions coaxially of the first and second columns, respectively, a plurality of identical beams, means on the first column and second wall for supporting an end of each beam of first and second groups of beams, and means on the second column and first wall for supporting the opposite ends of each beam of the first and second groups of beams, said first group forming a first sector-shaped floor and said second group of beams forming a second sector-shaped floor having an end adjacent an end of the first floor which provides a ramp to permit access between them.

2. A building of the character defined in claim 1, wherein each floor forms a sector of about 270°.

3. A prefabricated, multi-story building, comprising first and second columns adapted to be mounted in laterally spaced-apart, upright positions, first and second arcuate walls adapted to be mounted in upright positions coaxially of the first and second columns, respectively, a plurality of identical beams, means on the first column and second wall for supporting one end of each beam of a first group of beams and the other end of each beam of a second group of beams on one horizontal level, means on the second column and first wall for supporting the other end of each beam of the first group and the one end of each beam of the second group on another horizontal level, the top surfaces of the beams being so inclined that those of the first group form a first sector-shaped floor and those of the second group form a second sector-shaped floor having one end adjacent an end of the first floor which provides a ramp to permit access between the floors.

4. A building of the character defined in claim 3, wherein each floor forms a sector of about 270°.

5. A prefabricated, multi-story building, comprising first and second columns each having a support flange about a portion thereof and adapted to be mounted in laterally spaced-apart upright position with the flange of the first column at a lower level than that of the second column, first and second arcuate walls each having a support flange and adapted to be mounted in upright positions coaxially of the first and second columns, respectively, with the flange of the first wall on the same horizontal level of the support flange of the second column and the flange of the second wall on the same horizontal level of the support flange of the first column, and a plurality of identical beams having side edges which diverge from one end to the other, a first group of beams being adapted to be supported in side-by-side relation at one end on the support flange of the first column and at the other end on the support flange of the first wall to form a first inclined, sector-shaped floor, and a second group of beams being adapted to be supported in side-by-side relation at one end of the support flange of the second column and at the other end by the support flange of the second wall to form a second sector-shaped floor which has an end adjacent an end of the first floor, said beams having top surfaces which are asymmetrical end-for-end and so inclined that the end of the second floor defines a ramp which merges with the end of the first floor to permit access between the floors.

6. A building of the character defined in claim 5, wherein each group of beams forms a sector of about 270°.

* * * * *